US008322167B2

(12) United States Patent
Dias et al.

(10) Patent No.: US 8,322,167 B2
(45) Date of Patent: Dec. 4, 2012

(54) CUT-RESISTANT GLOVES

(75) Inventors: Tilak Dias, Stockport (GB); Kimberley Mitcham, Glenfield (GB)

(73) Assignee: BM Polyco Limited (GB)

( * ) Notice: Subject to any disclaimer, the term of this patent is extended or adjusted under 35 U.S.C. 154(b) by 272 days.

(21) Appl. No.: 12/600,966

(22) PCT Filed: May 27, 2008

(86) PCT No.: PCT/GB2008/001796

§ 371 (c)(1),
(2), (4) Date: Jun. 7, 2010

(87) PCT Pub. No.: WO2008/142432

PCT Pub. Date: Nov. 27, 2008

(65) Prior Publication Data

US 2010/0236294 A1 Sep. 23, 2010

(30) Foreign Application Priority Data

May 24, 2007 (GB) ..... 0710004.3

(51) Int. Cl.
*D04B 7/34* (2006.01)

(52) U.S. Cl. ..... 66/174

(58) Field of Classification Search ..... 66/174, 66/171, 170, 190, 202, 45; 2/16, 167, 169
See application file for complete search history.

(56) References Cited

U.S. PATENT DOCUMENTS

| | | | | | |
|---|---|---|---|---|---|
| 2,111,353 | A | * | 3/1938 | Berry | 66/174 |
| 3,115,760 | A | * | 12/1963 | Pierce | 66/65 |
| 3,788,103 | A | * | 1/1974 | Asai | 66/65 |
| 4,750,339 | A | * | 6/1988 | Simpson et al. | 66/172 R |
| 4,872,324 | A | * | 10/1989 | Rearwin et al. | 66/172 E |
| 6,003,344 | A | | 12/1999 | Castano | |

FOREIGN PATENT DOCUMENTS

| | | | |
|---|---|---|---|
| GB | 482651 | A | 8/1936 |
| GB | 1159113 | A | 1/1967 |

OTHER PUBLICATIONS

British Patent Office, Search Report under Section 17, in Application No. GB0710004.3, dated Nov. 7, 2007.

* cited by examiner

*Primary Examiner* — Danny Worrell
(74) *Attorney, Agent, or Firm* — McAndrews, Held & Malloy, Ltd.

(57) ABSTRACT

A cut-resistant fabric has at least a fabric section knitted with composite metallic core yarns (22, 24). One or each of some or all courses of the knitted section comprises a first core yarn (22) knitting alternate first stitches and a second core yarn (24) knitting alternate second stitches. Each core yarn (22, 24) extends between its respective alternate stitches floating in the intermediate stitch. This arrangement increases the bulk of the yarn material by unit area in the section, adding considerably to its cut-resistant properties. The fabric has a particular application in gloves for use in the meat-cutting and foam-cutting industries.

13 Claims, 1 Drawing Sheet

CUT-RESISTANT GLOVES

This invention relates to cut-resistant fabrics. There are numerous uses for cut-resistant fabrics. They can be used to protect products when subject to abrasive or aggressive treatment, or exposed thereto, and in protective clothing. The invention has particular application to gloves, mitts or sleeves made from a fabric knitted with metallic yarns. Gloves of this kind are used for example in the meat processing or foam cutting industries where objects of different shapes must be sawn through. Typically, band saws are used to which the operator is potentially exposed, in particular to cuts and lacerations in accidents that can result in amputated fingers.

Cut protection in gloves intended for use against band saw is usually provided by chainmail. However, chainmail gloves are heavy, lacking dexterity and can worsen the injury as the chain mail links can get caught by the rotating bandsaw and dragged towards the blade. On the other hand, lighter weight and more dexterous safety gloves do not provide sufficient cut resistance. Metallic yarns are known to be used to provide cut resistance in fabrics, and in gloves in particular. Such yarns are disclosed, for example, in U.S. Pat. No. 5,248,548, which yarns can be woven or knitted into fabrics. However, metallic yarns in high cut resistant gloves are usually a composite of stainless steel wires or yarns and polymer wrappings such as polyester, polyamide or aramid, to facilitate knitting. Whilst the metal content contributes to cut resistance, it provides poor protection against band saw blades, particularly those with smooth edges.

The present invention is directed at a cut-resistant fabric with at least a fabric section thereof knitted with metallic core yarns. In the or each fabric section, each course of knitting comprises a first core yarn knitting alternate first stitches, and a second core yarn knitting alternate second stitches. Each core yarn extending between its respective alternate stitches floats in the intermediate stitch. As a result the total number of metal-to-metal yarn contact points will increase; which increases the frictional energy of the knitted structure resulting in increased cut resistance properties. This arrangement also increases the bulk of the yarn material per unit area in the section, adding considerably to its cut-resistant properties. Also, by increasing the number of contact points per unit length of yarn, the section is less readily distorted or extended, which further enhances its cut-resistant properties.

The metallic yarn fabric section in a fabric according to the invention will of course normally be disposed in the zone most likely to be exposed to danger. The remainder of the fabric can comprise different yarns or the same yarns in a normal knitting pattern. However, in many circumstances the entire fabric may be knitted with the same cut-resistant knitting pattern.

In fabrics of the invention, each core yarn is normally a multi-filament yarn. Stainless steel is the preferred material for the core yarns whether they are mono-filament or multi-filament. Each core yarn will normally comprise two component yarns folded in a relaxed twist.

To provide additional cut-resistance, at least one additional yarn may be wrapped around at least one of the core yarns in the fabric section or the entire fabric according to the invention. Such an additional yarn may be mono-filament or multi-filament, with multi-filament being preferred. The additional yarn will typically be a metallic yarn, and preferably comprise one of tungsten, platinum, zirconium, titanium and chromium.

Yarns consisting entirely of metal have been known to be knitted into fabrics, then cut-and-sewn into appropriate shapes. When this is applied to gloves, the resulting product loses dexterity especially as it contains seams at the fingers. The present invention resolves this problem as the knitting techniques allow for seamless knitting of metallic multifilament yarns that also combine excellent dexterity with superior cut resistance.

As noted above in preferred gloves of the invention, the composite yarns have an additional filament or filaments wound around a core comprising the stainless steel filaments. In the core the stainless steel filaments will normally be twisted in one sense with the additional filament or filaments wound around it, normally in the other sense. The additional filament or filaments thereby enclose the stainless steel core. The core may itself comprise a plurality of component yarns of stainless steel filaments, folded in a relaxed twist. The additional filament can be applied to the core either individually, or as a single filament with others in an additional component.

While gloves according to the invention have sufficient flexibility for normal use, their elasticity is limited. Where this is a problem, it can be mitigated by including a portion of stretchable fabric in a suitable section of the glove. As in use some sections of the glove will be less exposed to risk than others, a suitable section can be selected. This is normally a part which covers the back of the hand. Such a stretchable portion can be knitted into the glove using suitable yarns, by the known intarsia technique.

Other mechanisms can also be used to facilitate fitting of a glove according to the invention to the hand and movement thereof when in use. An open portion may be formed at the hand opening of the glove, typically in the form of a slit at one side, for example adjacent the thumb. A button hole or holes or other fixture elements can be knitted into the glove to enable the opening or slit to be closed when the glove is in use. Additionally, alternative fittings can be attached such as Velcro straps. The design of the glove can also be adapted to the shape of the hand. For example, its cross-section may be reduced below the finger crotches. Another possibility is to form the glove with a reinforcing wedge below the finger crotches to create an angle between the line of the thumb and the lines of the fingers.

Gloves according to the invention can be made on a flat bed knitting machine with two needle beds. Such a method comprises knitting each finger from its distal to its proximal end using a tubular knitting process; linking the proximal ends to form a core section; knitting the thumb; merging the core section with the proximal end of the thumb; and continuing to knit the core section to complete the glove. Using this technique, the thumbs and fingers, and the main glove body, can be knitted as shaped tubes in a continuous process. This technique also enables the cross-section of the glove body to be reduced, and a wedge introduced as discussed above. It is also possible, of course, to exploit the intarsia technique and fit patches or other element or features in the glove body.

A particular composite yarn suitable for use in gloves of the invention has two core components, each consisting of 90 fourteen micron stainless steel filaments in an S-twist of 175 twists per meter. The two component yarns are folded in a relaxed twist in the same sense and an additional component yarn consisting of ninety 12-14 micron stainless steel filaments and a single tungsten filament preferably of diameter 0.025 mm wrapped around the folded yarns in a Z-twist of 250 twists per meter.

The invention will now be described by way of example and with reference to the accompanying schematic drawings wherein.

Figure 1:
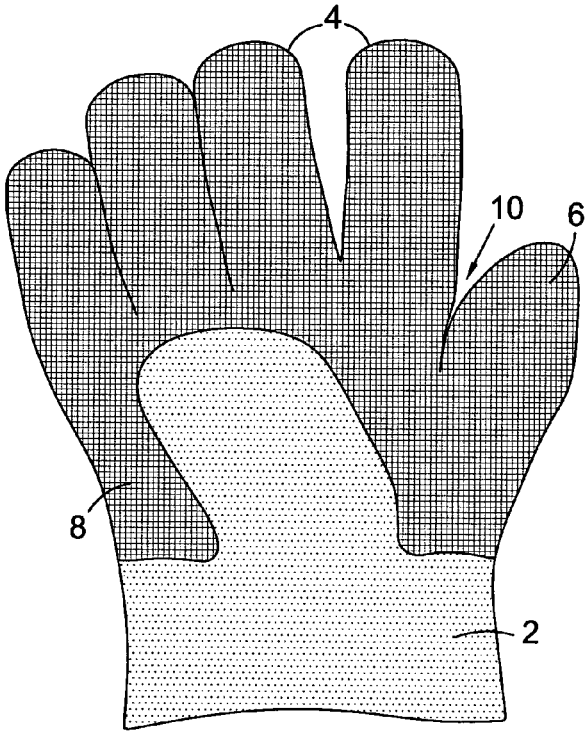
FIG. 1 illustrates a glove in accordance with the invention.

The glove shown in FIG. 1 is knitted on a flat bed knitting machine using two needle beds to simultaneously knit a "front" and a "back" of the glove. It is knitted from the fingers to the wrist, with a stretchable portion 2 incorporated by the intarsia technique at the wrist and extending into the visible "back" of the hand. The stitch length is reduced in the fingers 4 and thumb 6 of the glove relative to that in the body 8 on the visible "back" face. The "front" face can be knitted throughout with the shorter stitch length, this being an area of greater exposure. As can be seen, the cross-section of the body 8 is reduced just below the finger crotches where a wedge 10 is also formed. These two features assist in shaping the glove to better adapt it to a hand. The ends of the fingers and thumb are bound off, and all the yarn ends are knitted back on themselves to lock into the fabric. This assists in the finishing of the glove and allows the ends to be pulled and then cut off flush with the edges to prevent ladders or running.

Figure 2:
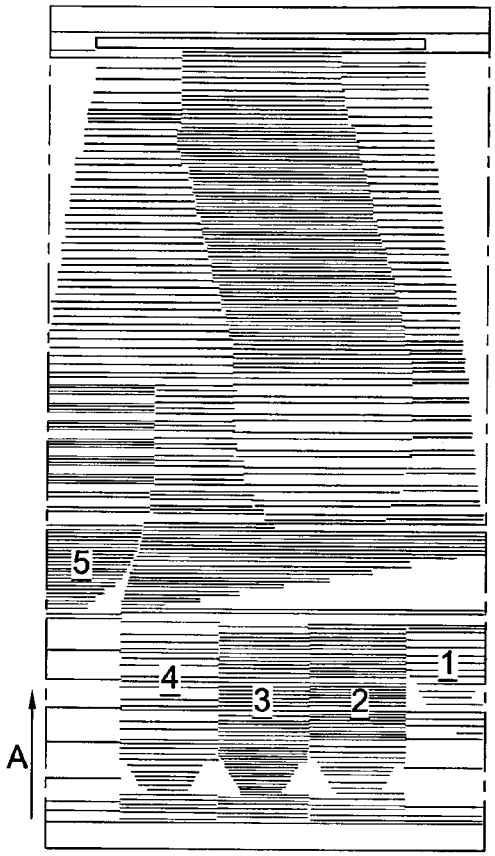
FIG. 2 illustrates a technique for knitting a glove of the kind shown in FIG. 1.

FIG. 2 illustrates how a glove of the kind shown in FIG. 1 can be knitted from the fingers to the wrist in the direction of arrow A. After knitting waste fabric to the takedown rollers, a draw thread is introduced to be able to separate the waste fabric from the glove when the knitting is completed.

The knitting of each of the fingers 1, 2, 3 and 4 starts in the same way. The yarn feeder (not shown) knits from the right hand side on empty needles (picking up). Between the first and second row of the stitches there are transfers which use the draw thread to lock down the first row of stitches. The second row is knitted from the left to the right. This is to enable the second row to be locked by the third row and facilitate the finishing of the glove when the knitting is completed, merely by pulling on loose ends of yarn. When the third row is knitted the closed distal end of the finger is finished closed.

The above procedure is carried out for the fingers 2, 3 and 4, and this can be carried out substantially simultaneously. A separate yarn feeder is used to knit each finger 1, 2, 3 and 4. During at least the initial parts of this stage, two waste yarns are knitted in preparation for knitting the smallest finger 1, and the thumb 5. As the fingers are knitted, the length of the knitted courses as well as both of the needle beds can be varied in length to dimensionally shape the finger to conform to that of a human finger.

As noted above, the fingers are knitted using a tubular knitting process with each course of stitches being knitted one on the front and one on the back needle bed. As the knitting of fingers 2, 3 and 4 continues, waste yarns are transferred to the rear needle bed ready for use in knitting the smallest finger; finger 1. This is initiated in the same way as the other fingers, and as this finger is completed, preparations are made to knit a thumb 5. The yarns used to knit finger 2 are knitted across the same area as finger 1. This allows the yarn to be locked at a following stage, and once again to minimise the number of loose ends of yarn to contend with when the process is completed. The same procedure can be adopted for other adjacent fingers.

The yarn used to knit finger 4 is locked into the fabric at the proximal end, and the yarn knitted out to the left hand side as shown is cast off. There are then, two courses of waste yarn and two course of draw thread knitted. The yarn feeder used to knit the finger 4 can now be used for the thumb 5, and as for the fingers, the first and second courses are used to lock the yarn at the welt of the thumb 5. The thumb 5 is now knitted, knitting alternately on the front and rear needle beds. Dimensional shaping is accomplished by varying the length of the respective courses.

The yarn feeder used to knit the finger 3 is used in the embodiment described to start knitting the core section of the glove and particularly the knuckle area. This area can also be dimensionally shaped enabling the angle at the proximal end of the fingers to be altered. At this stage a wedge can also be formed to align the proximal ends of the fingers with the normal shape of a human hand.

Figure 3:
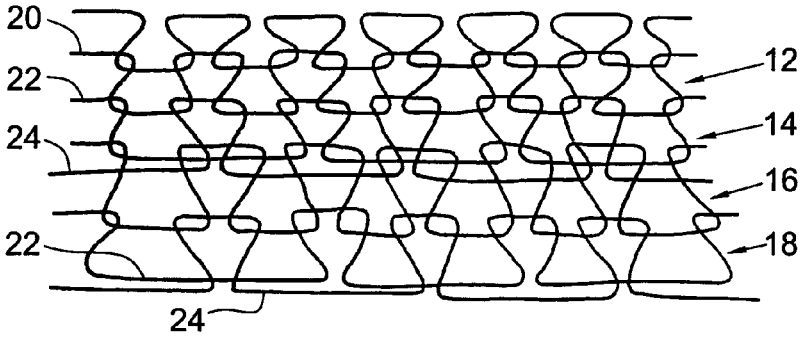
FIG. 3 shows the alternate extended stitches in a section of fabric knitted according to the invention.

FIG. 3 shows how the creation of extended stitches can increase the bulk of yarn per unit area in the fabric. Four courses are shown, as indicated at 12, 14, 16 and 18. Each of courses 12 and 16 has a single yarn 20 knitted with regular stitches of a standard length. In the alternate courses 14 and 18 each of two yarns 22 and 24 extends between two alternate stitches of the respective preceding course, with the yarn floating in the respective intermediate stitches between which the other of the two yarns extend. The floating lengths of yarn substantially increases the bulk of yarn in these courses, with a corresponding increase in the resistance of the knitted fabric a as whole to impact or cutting. It will be appreciated that the bulk of yarn can be further increased by adding one or more additional yarns to each of alternate courses, floating respectively in two or more intermediate stitches, or knitting multiple yarns separately in all courses of the fabric. However, as increasing the number of floating yarns can adversely affect the integrity of the knitted fabric, the arrangement illustrated, with floating yarns in alternate courses, is preferred.

The invention claimed is:

1. A glove comprising a cut-resistant fabric with at least a section knitted with composite metallic core yarns, where one or each of some or all courses of the knitted section comprises a first metallic core yarn knitting alternate first stitches and a second metallic core yarn knitting alternate second stitches, with each core yarn extending between its respective alternate stitches floating in the intermediate stitch.

2. A glove according to claim 1, wherein alternate courses of knitting in the fabric section comprise a first core yarn knitting alternate first stitches and a second core yarn knitting alternate second stitches, with each core yarn extending between its respective alternate stitches floating in the intermediate stitch.

3. A glove according to claim 1, wherein each core yarn in the fabric section is a multi-filament yarn.

4. A glove according to claim 1, wherein each core yarn in the fabric section comprises stainless steel.

5. A glove comprising a cut-resistant fabric section knitted with composite metallic core yarns, one or each of some or all courses of the knitted section comprising a first metallic core yarn knitting alternate first stitches and a second metallic core yarn knitting alternate second stitches, wherein each core yarn in the fabric section comprises two component yarns folded in a relaxed twist, and extends between its respective alternate stitches floating in the intermediate stitch.

6. A glove comprising a cut-resistant fabric section knitted with composite metallic core yarns, wherein one or each of some or all courses of the knitted section comprises a first metallic core yarn knitting alternate first stitches and a second metallic core yarn knitting alternate second stitches, with each core yarn extending between its respective, alternate stitches floating in the intermediate stitch; and wherein at least one additional yarn in the fabric is wound around at least one of the core yarns.

7. A glove according to claim 6, wherein the additional yarn is a multifilament yarn.

8. A glove according to claim 7, wherein the additional yarn is a multifilament metallic yarn.

9. A glove according to claim 6, wherein the additional yarn comprises one of tungsten, platinum, zirconium, titanium and chromium.

10. A glove according to claim 1 including a plurality of said sections knitted with composite metallic core yarns.

11. A glove according to claim 1 and being seamfree, and including a plurality of said sections knitted with composite metallic core yarns.

12. A glove according to claim 5, wherein alternate courses of knitting in the fabric comprise a first core yarn knitting alternate first stitches and a second core yarn knitting alternate second stitches, with each core yarn extending between its respective alternate stitches floating in the intermediate stitch.

13. A glove according to claim 6, wherein alternate courses of knitting in the fabric comprise a first core yarn knitting alternate first stitches and a second core yarn knitting alternate second stitches, with each core yarn extending between its respective alternate stitches floating in the intermediate stitch.

* * * * *